US008056440B2

(12) United States Patent
Choi

(10) Patent No.: US 8,056,440 B2
(45) Date of Patent: Nov. 15, 2011

(54) ADJUSTABLE PEDAL SYSTEM

(75) Inventor: Jin-Oh Choi, Gyeongsan-si (KR)

(73) Assignee: SL Corporation (KR)

( * ) Notice: Subject to any disclaimer, the term of this patent is extended or adjusted under 35 U.S.C. 154(b) by 152 days.

(21) Appl. No.: 12/399,715

(22) Filed: Mar. 6, 2009

(65) Prior Publication Data

US 2009/0223319 A1 Sep. 10, 2009

(30) Foreign Application Priority Data

Mar. 10, 2008 (KR) ..... 10-2008-0022127

(51) Int. Cl.
*G05G 1/30* (2008.04)

(52) U.S. Cl. ..... 74/512

(58) Field of Classification Search ..... 74/512, 74/513, 516, 560
See application file for complete search history.

(56) References Cited

U.S. PATENT DOCUMENTS 6,151,986 A * 11/2000 Willemsen et al. ..... 74/512
6,571,660 B2 * 6/2003 Gmurowski et al. ..... 74/512
6,782,776 B2 * 8/2004 Oberheide et al. ..... 74/512
2007/0137397 A1 * 6/2007 Choi ..... 74/512
2007/0157755 A1 * 7/2007 Kim et al. ..... 74/513

FOREIGN PATENT DOCUMENTS

JP 2002196835 12/2002
JP 2004082871 3/2004
KR 100649166 B1 11/2006

* cited by examiner

*Primary Examiner* — Vicky Johnson
(74) *Attorney, Agent, or Firm* — Lando & Anastasi, LLP

(57) ABSTRACT

Provided is an adjustable pedal system. The adjustable pedal system includes: a support bracket having a predetermined hole and a guide groove which are substantially perpendicular; a driving part including a driving arm which can make a substantially vertical motion along the guide groove and provides a driving force to the driving arm; a control arm including a hinge hole which is coupled to the driving arm by a first pin and a sliding slot which is coupled to the predetermined hole by a second pin and formed oblique to the guide groove; and a pedal arm having a pedal at one end thereof and being connected to the control arm at other end thereof, the control arm slides obliquely along the sliding slot according to the working of the driving arm when moves vertically along the guide groove and thus this causes a position of each of the control arm and the pedal arm to be changed.

8 Claims, 10 Drawing Sheets

ADJUSTABLE PEDAL SYSTEM

This application claims priority from Korean Patent Application No. 10-2008-0022127 filed on Mar. 10, 2008 in the Korean Intellectual Property Office, the disclosure of which is incorporated herein by reference in its entirety.

BACKGROUND OF THE INVENTION

1. Field of the Invention

The present invention relates to an adjustable pedal system, and more particularly, to a pedal system which can be adjusted according to a driver's body condition.

2. Description of the Related Art

For several decades, automobile producers and designers have taken interest in ergonomic aspects of automobiles to accommodate drivers of different body sizes. In an effort to accommodate drivers of different sizes, they have designed automobile controllers (such as a steering wheel) to be adjustable. In addition, they have recognized that all vehicle controllers operated by drivers are very important in terms of ergonomics and safety.

Control pedals are typically provided in a vehicle and foot-operated by the driver. Separate control pedals are provided for operating brakes and an accelerator. When the vehicle has a manual transmission, a third control pedal is provided for operating a transmission clutch. A front seat of the vehicle is typically mounted on tracks so that the seat is forwardly and rearwardly adjustable along the tracks. However, the technology of moving the front seat along the tracks is not sufficient to accommodate drivers of various sizes. Therefore, a technology which can adjust positions of the control pedals according to drivers of various sizes is required. This technology is called an adjustable pedal system.

Generally, pedal systems include pendent-type pedal systems which are used in passenger cars and floor-mounting-type pedal systems which are used in large vehicles such as buses.

In a floor-mounting-type pedal system, in particular, a rail is often installed at a lower end of a pedal to control the position of the pedal. Thus, a large space is required for the pedal system in a vehicle. In addition, since separate operating structures are needed for a brake pedal and an accelerator pedal, the structure of the pedal system becomes complicated, and the cost of the pedal system is increased.

SUMMARY OF THE INVENTION

Aspects of the present invention provide a simple-structured, adjustable pedal system which can optimize the layout of the space inside a vehicle and thus increase the utilization of the lower space inside the vehicle.

However, aspects of the present invention are not restricted to the one set forth herein. The above and other aspects of the present invention will become more apparent to one of ordinary skill in the art to which the present invention pertains by referencing the detailed description of the present invention given below.

According to an aspect of the present invention, there is provided an adjustable pedal system including: a support bracket having a predetermined hole and a guide groove which are substantially perpendicular; a driving part including a driving arm which can make a substantially vertical motion along the guide groove and provides a driving force to the driving arm; a control arm including a hinge hole which is coupled to the driving arm by a first pin and a sliding slot which is coupled to the predetermined hole by a second pin and formed oblique to the guide groove; and a pedal arm having a pedal at one end thereof and being connected to the control arm at other end thereof, the control arm slides obliquely along the sliding slot according to the working of the driving arm when moves vertically along the guide groove and thus this causes a position of each of the control arm and the pedal arm to be changed.

BRIEF DESCRIPTION OF THE DRAWINGS

The above and other aspects and features of the present invention will become more apparent by describing in detail exemplary embodiments thereof with reference to the attached drawings, in which.

DETAILED DESCRIPTION OF THE INVENTION

Figure 1:
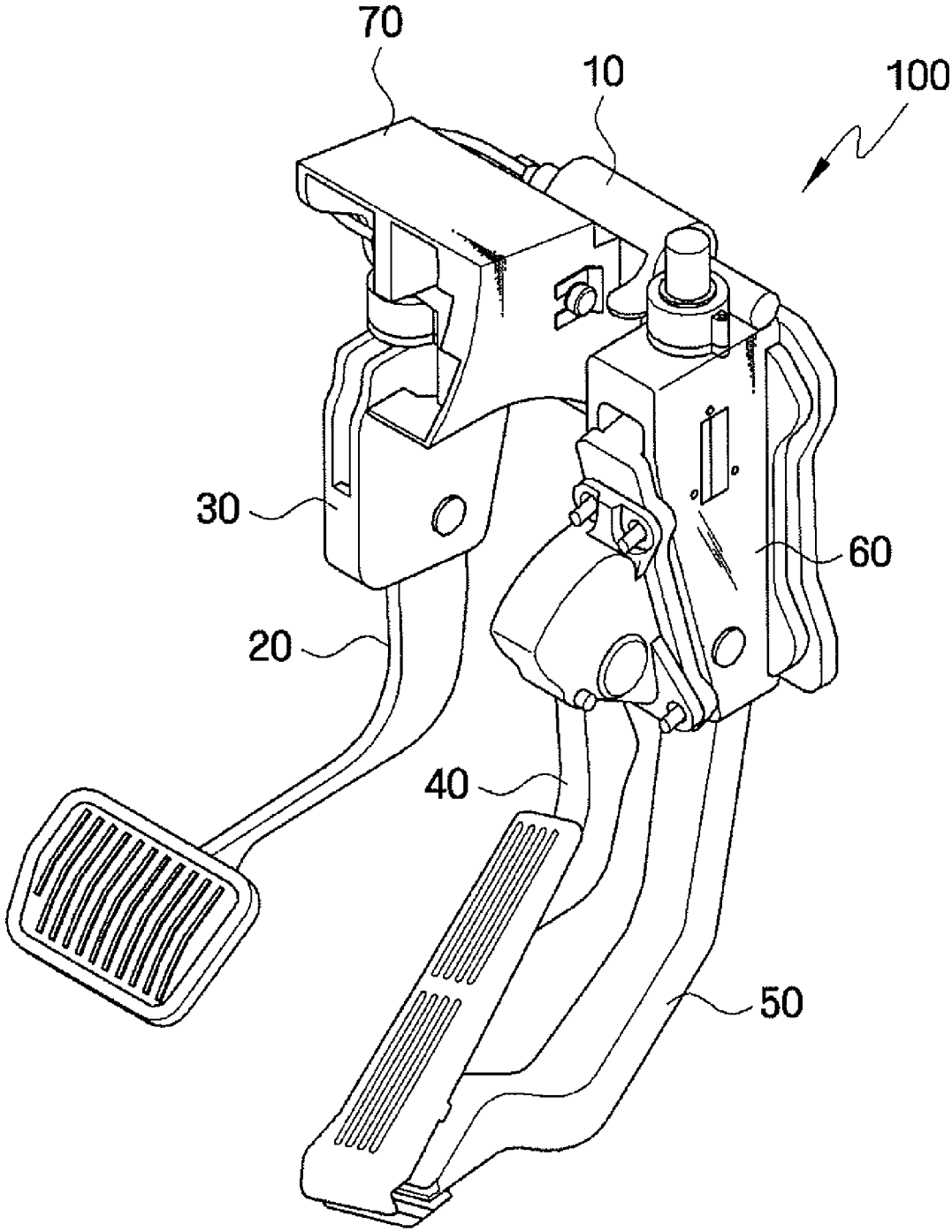
FIG. 1 is a schematic perspective view of an adjustable pedal system according to an embodiment of the present invention.

Advantages and features of the present invention and methods of accomplishing the same may be understood more readily by reference to the following detailed description of exemplary embodiments and the accompanying drawings. The present invention may, however, be embodied in many different forms and should not be construed as being limited to the embodiments set forth herein. Rather, these embodiments are provided so that this disclosure will be thorough and complete and will fully convey the concept of the invention to those skilled in the art, and the present invention will only be defined by the appended claims. Like reference numerals refer to like elements throughout the specification.

In some embodiments, well-known processing processes, well-known structures and well-known technologies will not be specifically described in order to avoid ambiguous interpretation of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated components, steps, operations, and/or elements, but do not preclude the presence or addition of one or more other components, steps, operations, elements, and/or groups thereof. As used herein, the term "and/or" includes any and all combinations of one or more of the associated listed items.

Embodiments of the invention are described herein with reference to cross-section illustrations that are schematic illustrations of idealized embodiments of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing. For ease of description, components illustrated in the drawings of the present invention may have been somewhat enlarged or reduced. Throughout the specification, like reference numerals in the drawings denote like elements.

Hereinafter, an adjustable pedal system according to embodiments of the present invention will be described in detail with reference to the attached drawings.

Figure 2:
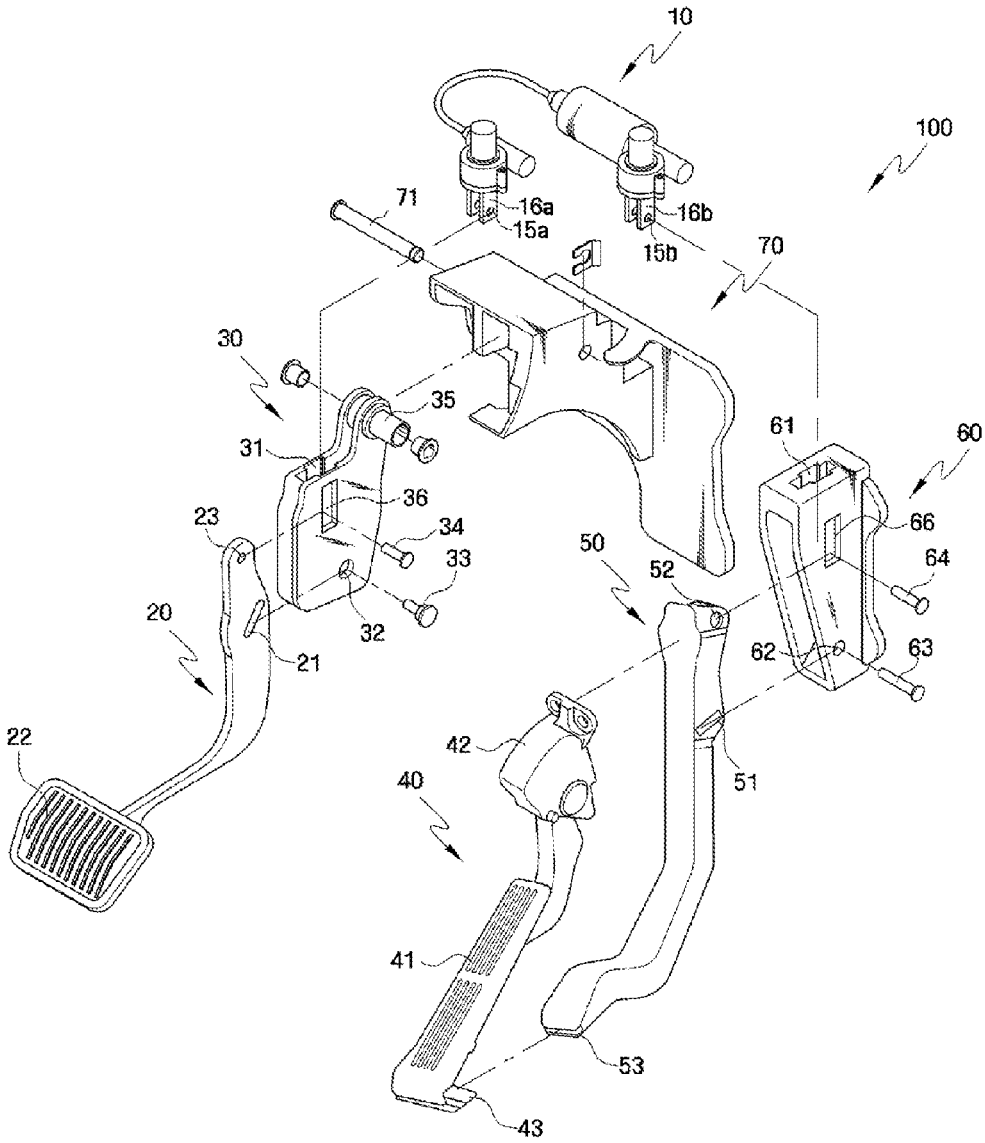
FIG. 2 is an exploded perspective view of the adjustable pedal system shown in FIG. 1.

FIG. 1 is a schematic perspective view of an adjustable pedal system 100 according to an embodiment of the present invention. FIG. 2 is an exploded perspective view of the adjustable pedal system 100 shown in FIG. 1.

The adjustable pedal system 100 according to the present embodiment may include a driving part 10, a brake pedal arm 20, a first support bracket 30, an accelerator pedal arm 40, a control arm 50, a second support bracket 60, and a main bracket 70. In the drawings, the adjustable pedal system 100 includes two control pedals, that is, a brake pedal 22 and an accelerator pedal 41. However, it is obvious to those skilled in the art that a transmission clutch pedal can be added as a third control pedal.

Figure 3:
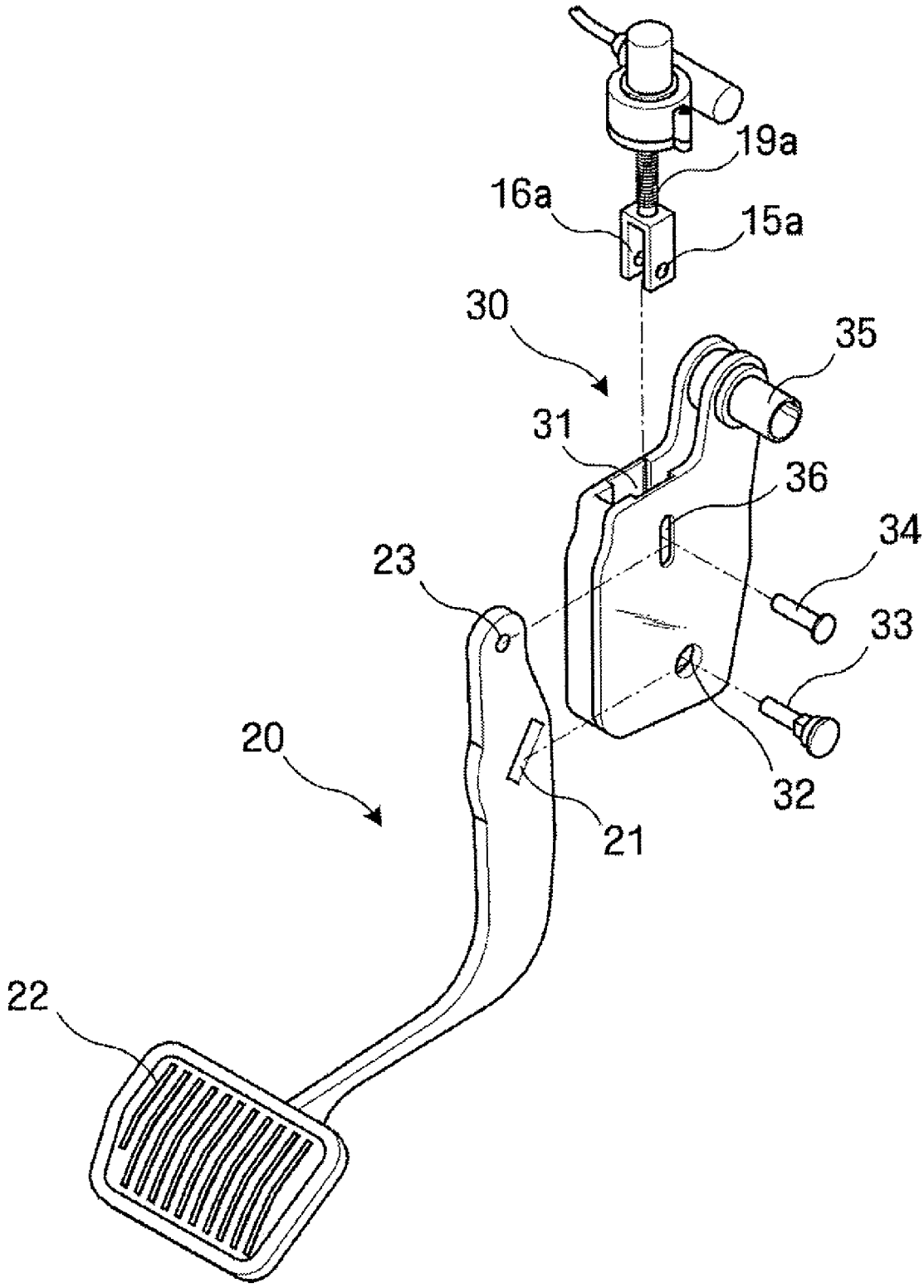
FIG. 3 is an exploded perspective view of a driving part, a first support bracket, and a brake pedal arm connected to each other and included in the adjustable pedal system of FIG. 1.

FIG. 3 is an exploded perspective view of the driving part 10, the first support bracket 30, and the brake pedal arm 20 connected to each other and included in the adjustable pedal system 100 of FIG. 1.

The brake pedal arm 20 may have the brake pedal 22 at an end thereof and a hinge hole 23 in the other end thereof. Inside the first support bracket 30, the hinge hole 23 formed in the brake pedal arm 20 may be coupled to assembly holes 15*a*, which are formed in a driving arm 16*a*, by a first pin 34. Therefore, the brake pedal arm 20 can rotate around the hinge hole 23, that is, the first pin 34, within a predetermined range with respect to the driving arm 16*a*.

A sliding slot 21 may be formed in the brake pedal arm 20. Therefore, when receiving a vertical driving force from the driving part 10, the brake pedal arm 20 may make a linear motion along the sliding slot 21.

As shown in FIG. 3, the first support bracket 30 may include two plates which are separated from each other and face each other. The two plates may be fixed and thus coupled to each other by a coupling medium.

A guide groove 31 to be substantially perpendicular and a hole 32 may be formed in the first support bracket 30. Therefore, the driving arm 16*a* coupled to the brake pedal arm 20 by the first pin 34 can make an upward or downward linear motion along the guide groove 31 of the first support bracket 30. That is, if a jackscrew 19*a* of the driving part 10 makes a downward linear motion, its downward linear motion is delivered to the driving arm 16*a*, thereby causing the hinge hole 23 to move downward.

By inserting a second pin 33 in the hole 32 formed in the first support bracket 30 to correspond to the sliding slot 21, the brake pedal arm 20 may be connected to the first support bracket 30. Unlike the first pin 34, the second pin 33 can rotate according to the motion of the sliding slot 21 within a predetermined range, which will be described in detail later with reference to FIG. 5.

Referring to FIG. 3, a vertical slot 36 may be formed in a side or both sides of the first support bracket 30. The vertical slot 36 is penetrated by the first pin 34 and assists in guiding the vertical motion of the driving arm 16*a*. Alternatively, the vertical slot 36 may not be formed. In this case, the hinge hole 23 of the brake pedal arm 20, the first pin 34, and the driving arm 16*a* may all be located within the guide groove 31 of the first support bracket 30.

If a sliding slot for rotating a pedal arm are not provided in either of the first support brackets 30, inner and outer portions of the first support brackets 30 can be efficiently sealed and thus relatively free from external impurities such as particles.

The first support bracket 30 may be coupled to the main bracket 70 to be rotatable at a predetermined angle with respect to the main bracket 70. To this end, a hinge hole 35 formed in the first support bracket 30 may be coupled to the main bracket 70 by a coupling pin 71. When a driver steps on the brake pedal 22, the first support bracket 30 can be rotated around the coupling pin 71 by a predetermined angle.

Figure 4:
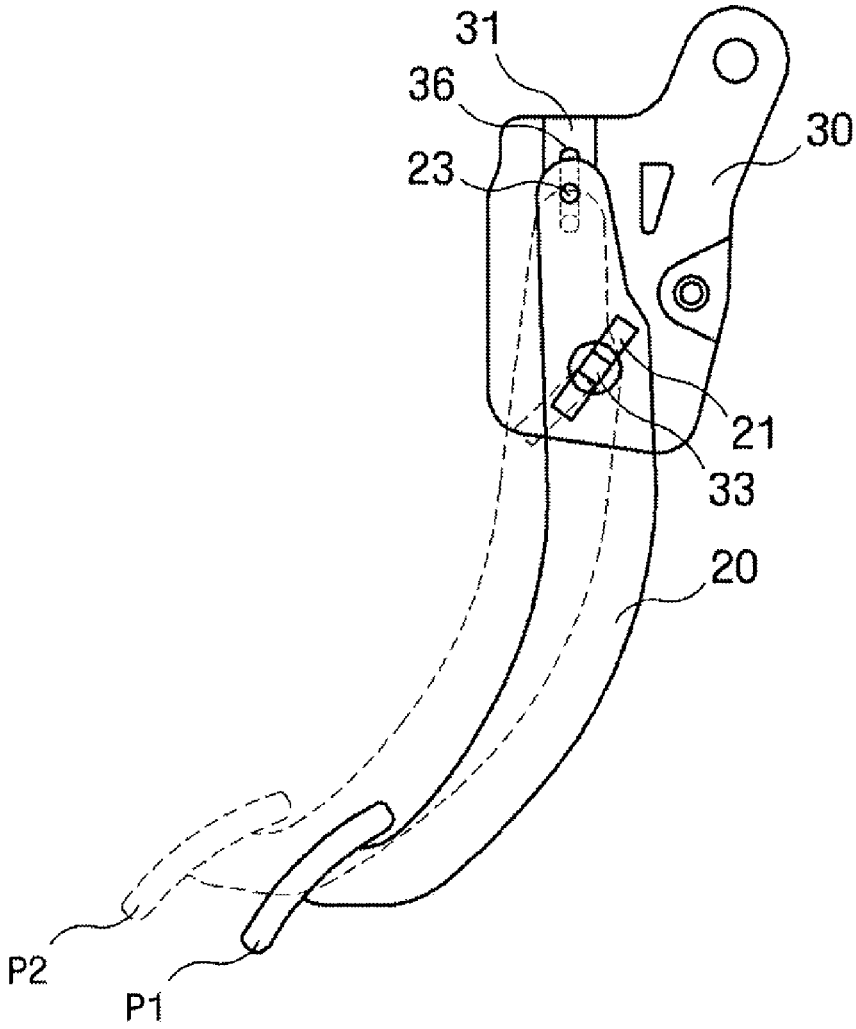
FIG. 4 is a view for explaining an example of controlling the position of the brake pedal arm in the adjustable pedal system of FIG. 1.

FIG. 4 is a view for explaining an example of controlling the position of the brake pedal arm 20 in the adjustable pedal system 100 of FIG. 1. FIG. 4 shows the first support bracket 30 from which one of the two plates has been removed.

Referring to FIG. 4, if the hinge hole 23 moves downward according to the descent of the jackscrew 19*a*, the second pin 33 and the sliding slot 21 may make linear motions relative to each other. Here, since the second pin 33 cannot make a linear motion while it can make a rotary motion in its place, the sliding slot 21 may move obliquely. Accordingly, the brake pedal 22 attached to the brake pedal arm 20 may move from a position P1 to a position P2, that is, move forward. Conversely, if the jackscrew 19*a* moves upward, the brake pedal 22 may move backward due to the same operating principle.

Figure 5:
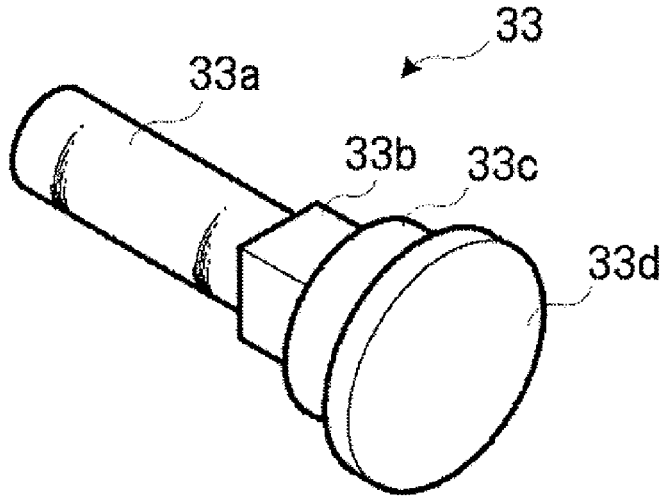
FIG. 5 shows the detailed structure of a second pin included in the adjustable pedal system of FIG. 1.

FIG. 5 shows the detailed structure of the second pin 33 included in the adjustable pedal system 100 of FIG. 1.

Referring to FIG. 5, the second pin 33 may include a central axis portion 33*a* which passes through the first support bracket 30, a square axis portion 33*b* which is coupled to the sliding slot 21, a circular axis portion 33*c* which is coupled to the hole 32 of the first support bracket 30, and a knob 33*d* which fixes the second pin 33 in an axial direction. A height of the square axis portion 33*b* is almost equal to a width of the sliding slot 21, and a diameter of the circular axis portion 33*c* is almost equal to that of the hole 32 of the first support bracket 30. Here, the square axis portion 33*b* may have a clearance for linear motion relative to the sliding slot 21. Likewise, the circular axis portion 33*c* may have a clearance for rotary motion relative to the hole 32. The structure of a fourth pin 63, which will be described later, is similar to that of the second pin 33.

Figure 6:
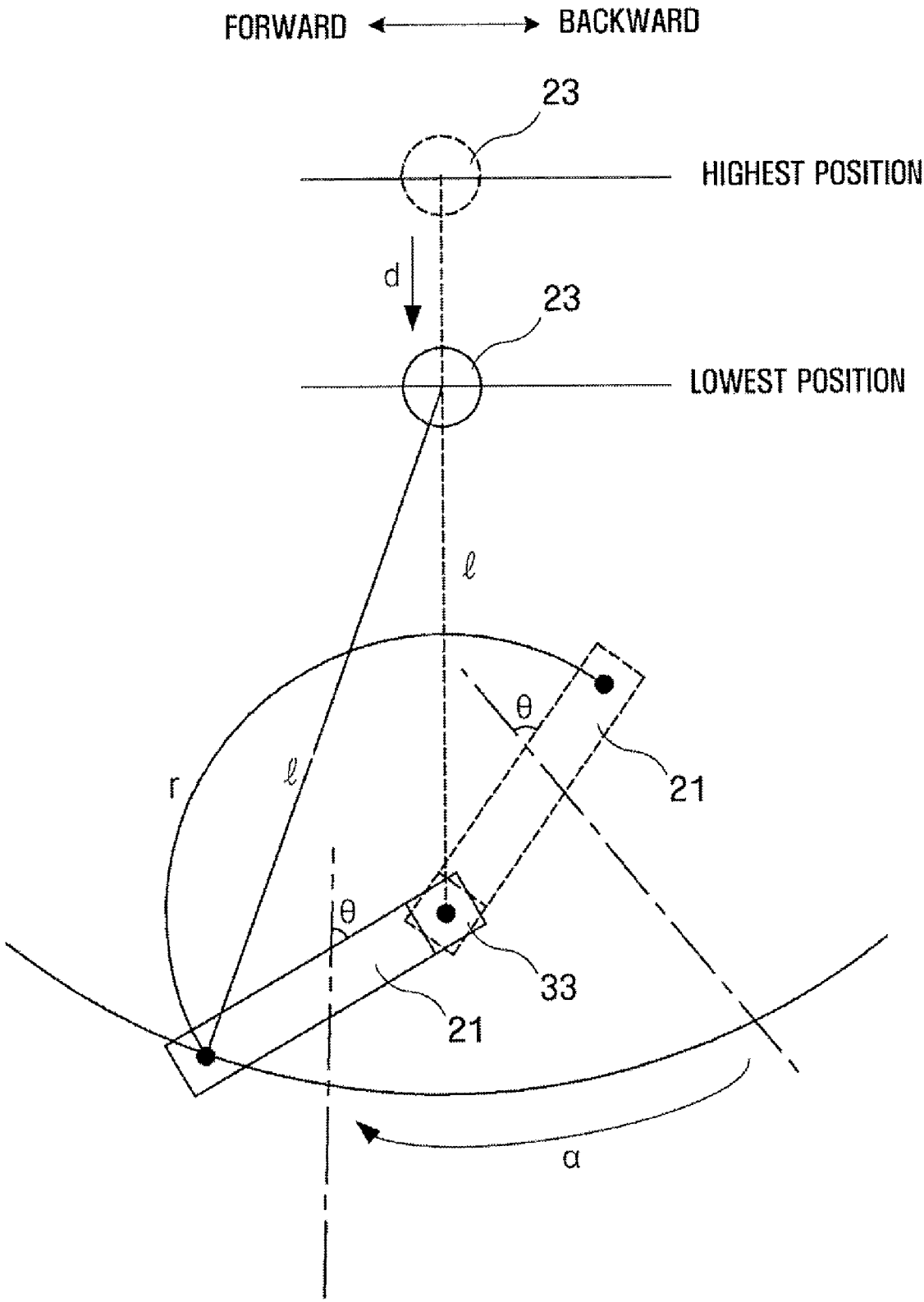
FIG. 6 illustrates the motion of the brake pedal arm of the adjustable pedal system of FIG. 1 in a mechanical sense.

FIG. 6 illustrates the motion of the brake pedal arm 20 of the adjustable pedal system 100 of FIG. 1 in a mechanical sense.

Since the brake pedal arm 20 is a rigid body, a distance between the hinge hole 23 and a position in the sliding slot 21 and an angle θ formed by the sliding slot 21 and brake pedal arm 20 remain unchanged.

When the hinge hole 23 is at its highest position, the square axis portion 33*b* of the second pin 33 is located at a front end of the sliding slot 21. Here, a distance between the hinge hole 23 and the center of the square axis portion 33*b* is indicated by "l." When the hinge hole 23 is lowered to its lowest position by a distance "d," the position of the sliding slot 21, that is, the position of the brake pedal arm 20 may be obtained by finding an intersecting point of a circle with a radius of l from the center of the hinge hole 23 at its lowest position and a circle with a radius of "r" (the length of the sliding slot 21 minus the width of the square axis portion 33*b*) from the center of the square axis portion 33*b*. In this case, the intersecting point may be the most front position in the sliding slot 21 at which the center of the square axis portion 33*b* can be located. It can be seen from FIG. 6 that the square axis portion 33*b* is somewhat rotated while the hinge hole 23 is lowered to its lowest position.

As is apparent from the example of FIG. 6, while the hinge hole 23 moves from its highest position to lowest position, the brake pedal 22 moves somewhat downward while rotating forward at an angle of $\alpha$. Thus, the maximum angle or distance by which the brake pedal 22 can move can be obtained by controlling the angle $\theta$ of the sliding slot 21, an effective length "r" of the sliding slot 21, and an effective length "d" of the guide groove 31 based on the above mechanical relations.

Meanwhile, the above motion of the brake pedal arm 20 may also apply to that of the accelerator pedal arm 40 which will be described later.

Figure 7:
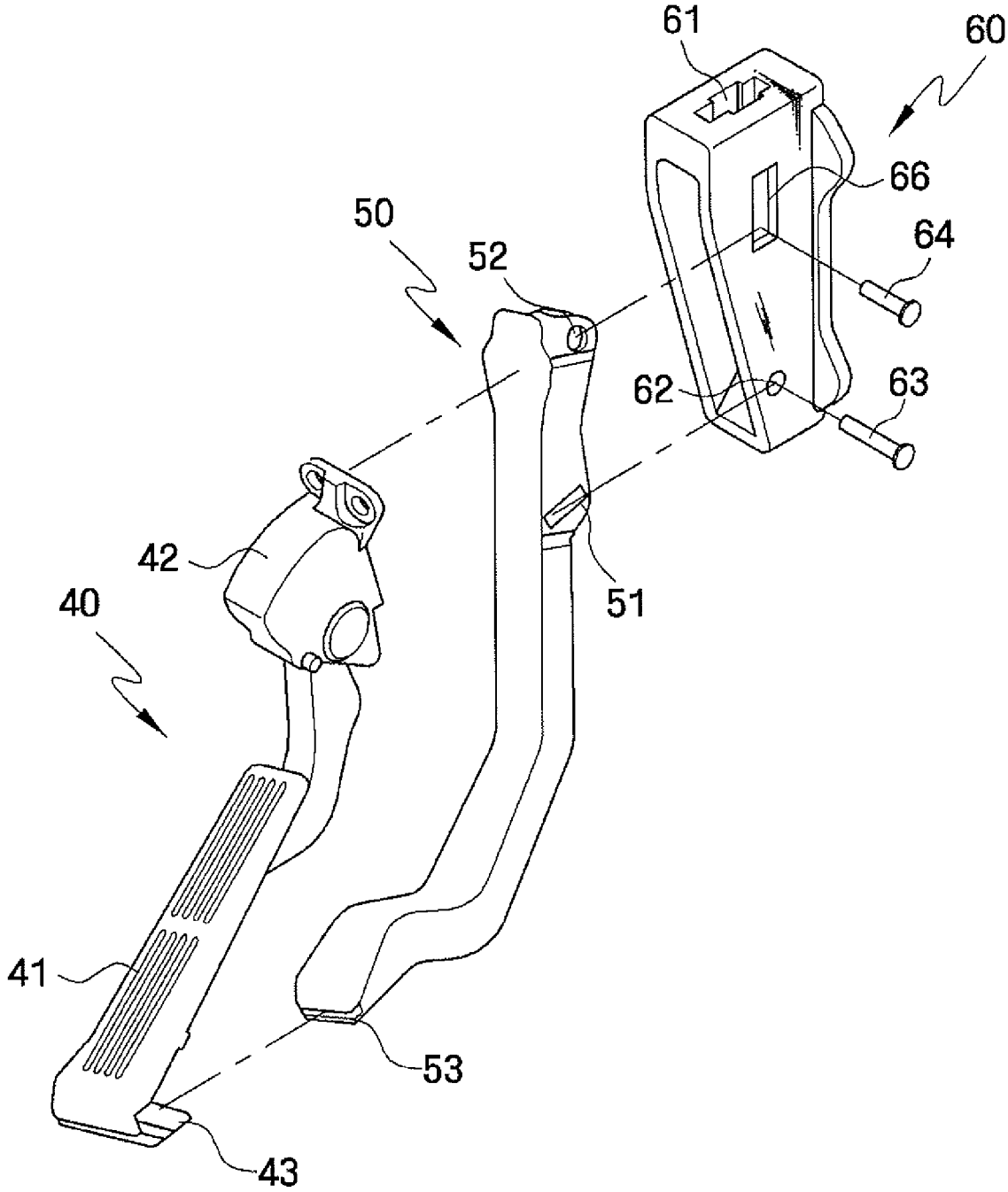
FIG. 7 is an exploded perspective view of a second support bracket, a control arm, and an accelerator pedal arm connected to each other and included in the adjustable pedal system of FIG. 1.

FIG. 7 is an exploded perspective view of the second support bracket 60, the control arm 50, and the accelerator pedal arm 40 connected to each other and included in the adjustable pedal system 100 of FIG. 1.

On the whole, the accelerator pedal arm 40 may have a similar structure to the brake pedal arm 20. However, the accelerator pedal arm 40 is not directly connected to the second support bracket 60. Instead, the accelerator pedal arm 40 may be indirectly connected to the second support bracket 60 by the control arm 50. The control arm 50 may substantially be "⌊"-shaped. However, since a middle portion of the control arm 50 is inclined at a predetermined angle, no rear space is required.

Referring to FIG. 7, the accelerator pedal arm 40 may have the accelerator pedal 41 at an end thereof and have the other end connected to the control arm 50. The accelerator pedal 40 and the control arm 50 may be fixed to each other by a coupling medium so that they do move relative to each other. Accordingly, the accelerator pedal arm 40 and the control arm 50 may be adjusted together. That is, the accelerator pedal arm 40 and the control arm 50 may rotate around a hinge hole 52 which is formed in an end of the control arm 50.

The accelerator pedal 41 is substantially shaped like a rectangular plate. A film-type hinge part 43 may be formed at a lower end of the accelerator pedal 41 so that a driver can control the accelerator pedal 41 with his or her tiptoes while resting his or her heel on the floor of a vehicle. In addition, another hinge part 53 may be formed at a lower end of the control arm 50 to correspond to the hinge part 43. Therefore, according to the driver's operation, the accelerator pedal 41 may rotate at an angle around the lower end of the accelerator pedal 41. Here, a connector, which connects the accelerator pedal 41 to the control arm 50, may be shaped like small cymbals such that it can absorb a certain degree of deviation resulting from the driver's operation. However, the shape of the connector is not limited to the above example and can be changed by those skilled in the art.

Inside the second support bracket 60, the hinge hole 52 formed in the control arm 50 may be coupled to assembly holes 15*b*, which are formed in a driving arm 16*b*, by a third pin 64. Therefore, the control arm 50 can rotate around the hinge hole 52, that is, the third pin 64, within a predetermined range with respect to the driving arm 16*b*.

A sliding slot 51 may be formed in the control arm 50. Therefore, when receiving a vertical driving force from the driving part 10, the control arm 50 may make a linear motion along the sliding slot 51.

As shown in FIG. 7, the second support bracket 60 may include two plates which are separated from each other and face each other. The two plates may be fixed and thus coupled to each other by a coupling medium.

A guide groove 61 to be substantially perpendicular and a hole 62 may be formed in the second support bracket 60. Therefore, the driving arm 16*b* coupled to the control arm 50 by the third pin 64 can make an upward or downward linear motion along the guide groove 61 of the second support bracket 60. That is, if a jackscrew 19*b* of the driving part 10 makes a downward linear motion, its downward linear motion is delivered to the driving arm 16*b*, thereby causing the hinge hole 52 to move downward.

By inserting a forth pin 63 in hole 62 formed in the second support bracket 60 to correspond to the sliding slot 51, the control arm 50 may be fixed to the second support bracket 60. Unlike the third pin 64, the fourth pin 63 can rotate according to the motion of the sliding slot 51 within a predetermined range. The structure of the fourth pin 63 may be identical to that of the second pin 33 described above with reference to FIG. 5.

Referring to FIG. 7, a vertical slot 66 may be formed in a side or both sides of the second support bracket 60. The vertical slot 66 is penetrated by the third pin 64 and assists in guiding the vertical motion of the driving arm 16*b*.

A speed controller 42 may be installed at the end of the accelerator pedal arm 40 which is connected to the control arm 50. In this case, the accelerator pedal arm 40 may be connected to the control arm 50 by the speed controller 42. When a driver operates the accelerator pedal 41, the speed controller 42 measures the quantity of motion or rotation of the accelerator pedal arm 40. Based on the measurement results, the speed controller 42 adjusts the amounts of fuel and air supplied to an engine, thereby controlling the rotation of the engine. In this way, the speed controller 42 controls the speed of the vehicle. The speed controller 42 may include a sensor (not shown) which measures the quantity of motion or rotation of the accelerator pedal arm 40.

Figure 8:
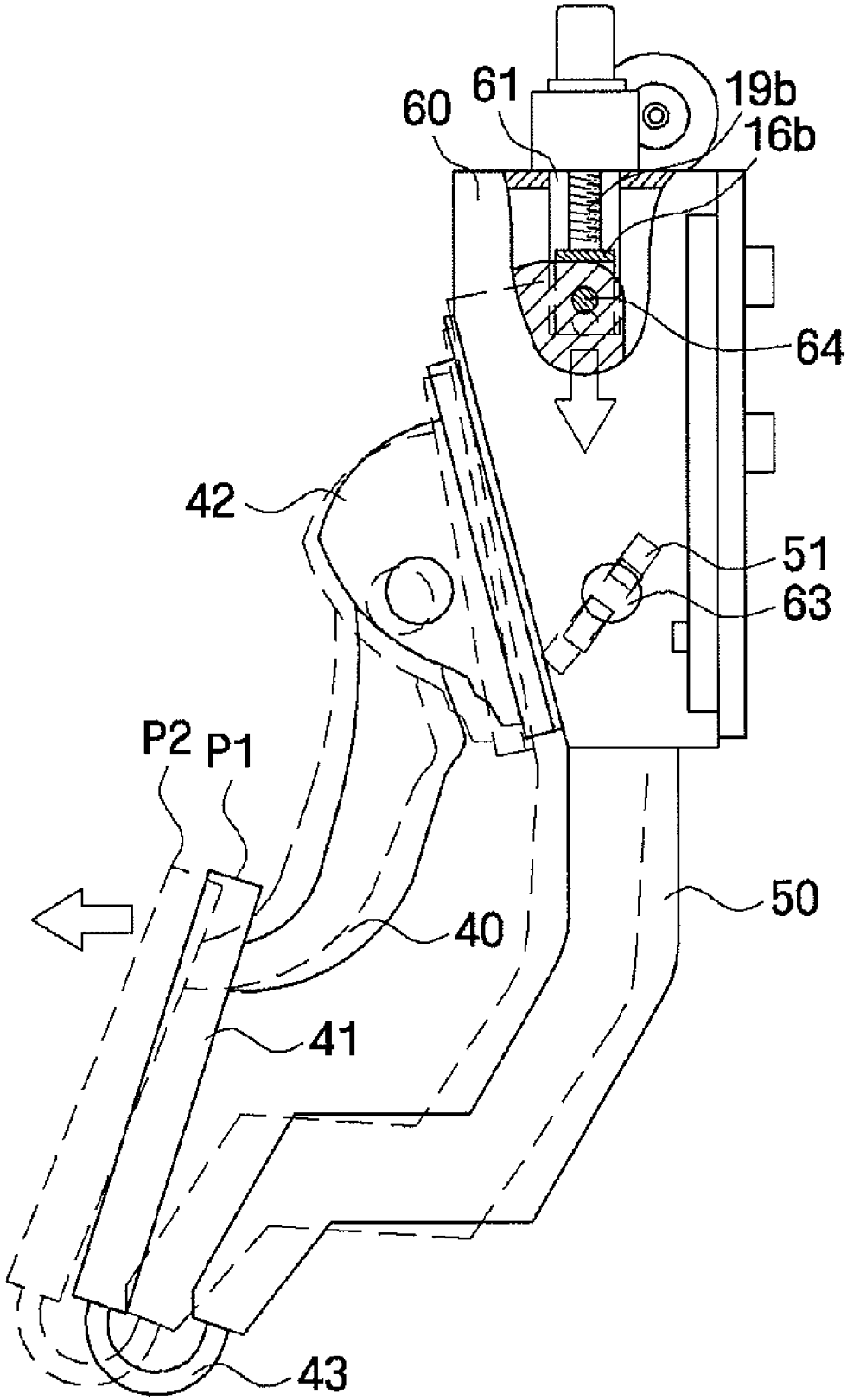
FIG. 8 is a view for explaining an example of controlling the position of the accelerator pedal arm in the adjustable pedal system of FIG. 1.

FIG. 8 is a view for explaining an example of controlling the position of the accelerator pedal arm 40 in the adjustable pedal system 100 of FIG. 1. The accelerator pedal 41 may be controlled in the same way that the brake pedal 22 is controlled as described above with reference to FIG. 4.

Referring to FIG. 8, if the hinge hole 52 moves downward according to the descent of the jackscrew 19*b*, the fourth pin 63 and the sliding slot 51 may make linear motions relative to each other. Here, since the fourth pin 63 cannot make a linear motion while it can make a rotary motion in its place, the sliding slot 51 may move obliquely. Accordingly, the accelerator pedal 41 attached to the accelerator pedal arm 40 may move from a position P1 to a position P2, that is, move forward. Conversely, if the jack screw 19*b* moves upward, the accelerator pedal 41 may move backward due to the same operating principle.

In a conventional floor-mounting-type pedal system used in large vehicles such as buses, a rail is often installed at a lower end of a pedal to control the position of the pedal. Thus, a large space is required for the pedal system in a vehicle. In addition, since separate operating structures are needed for a brake pedal and an accelerator pedal, the structure of the pedal system becomes complicated, and the cost of the pedal system is increased.

However, in the adjustable pedal system 100 according to the present embodiment, the accelerator pedal arm 40 is coupled to the control arm 50 while an upper end of the accelerator pedal 41 is connected to the accelerator pedal arm 40 and the lower end of the accelerator pedal 41 is connected to the control arm 50. Accordingly, the position of the accelerator pedal 41 can be controlled in the same way that the position of the pedal in the floor-mounting-type pedal system is controlled, without installing a rail at the lower end of the accelerator pedal 41. Consequently, the space inside a vehicle can be efficiently used, and the appearance of the interior of the vehicle can be improved. Moreover, since the adjustable pedal system 100 can have an integrated structure for the brake pedal 22 and the accelerator pedal 41, its structure can be simplified, resulting in a reduction in the cost of the adjustable pedal system 100.

Figure 9:
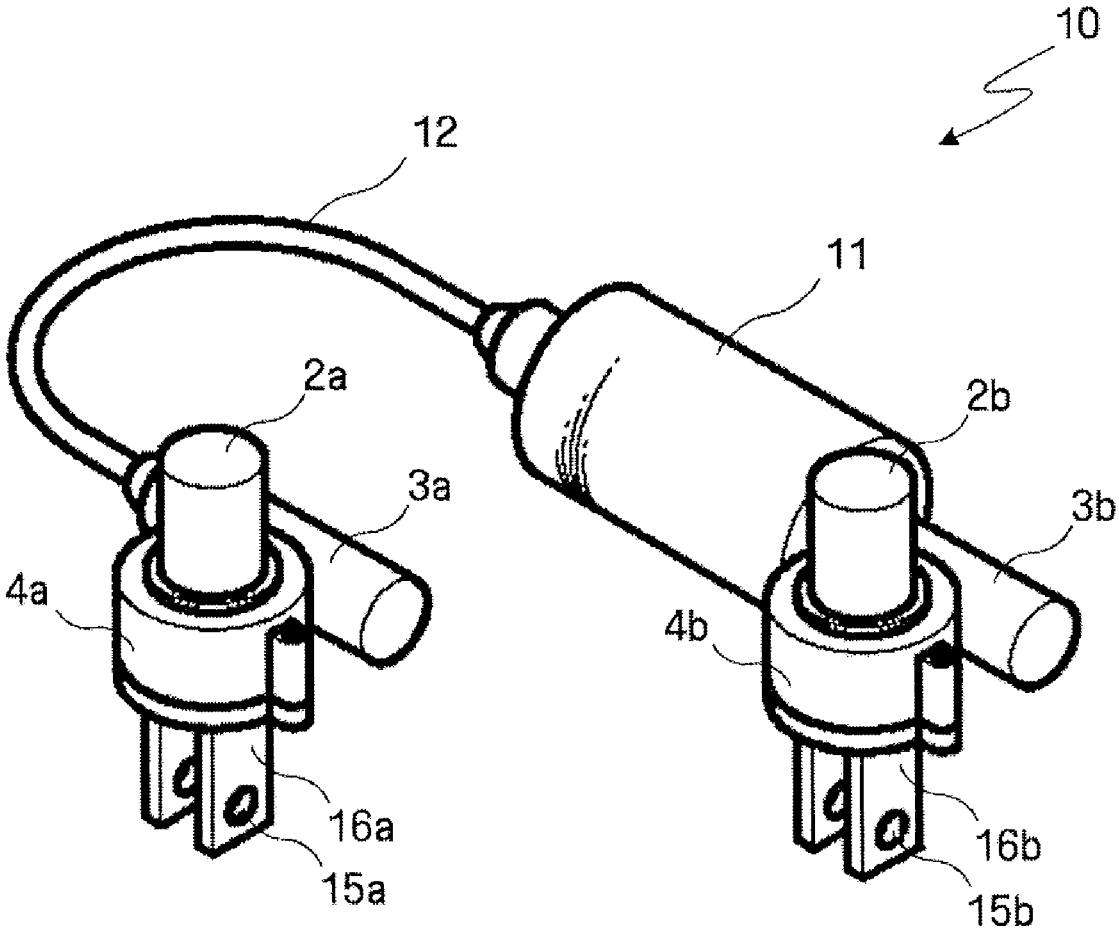
FIG. 9 shows the structure of the driving part included in the adjustable pedal system of FIG. 1.

FIG. 9 shows the structure of the driving part 10 included in the adjustable pedal system 100 of FIG. 1.

Referring to FIG. 9, the driving part 10 may include a rotation motor 11, worm gear housings 3*a* and 3*b*, pinion gear housings 4*a* and 4*b*, the driving arms 16*a* and 16*b*, screw housings 2*a* and 2*b*, and a hard wire 12. The worm gear housings 3*a* and 3*b* respectively accommodate worm gears which are directly or indirectly connected to the rotation motor 11. The pinion gear housings 4*a* and 4*b* accommodate pinion gears which are coupled to the worm gears, respectively. The driving arms 16*a* and 16*b* are coupled to the pinion gears by screws, respectively. The screw housings 2*a* and 2*b* accommodate portions of the screws which protrude from the pinion gears, respectively. The hard wire 12 remotely delivers power of the rotation motor 11.

If the driving part 10 structured as shown in FIG. 9 is operates, the driving arm 16*a* may move downward as the pinion gear of the driving part 10 rotates. Then, the brake pedal arm 20 having the hinge hole 23, which is coupled to the assembly holes 15*a* of the driving arm 16*a* by the first pin 34, may move downward along the guide groove 31 of the first support bracket 30. Here, the brake pedal arm 20 may move forward while making a linear motion along the sliding slot 21 formed in an oblique direction. The above operation may also apply to the accelerator pedal arm 40.

Figure 10A:
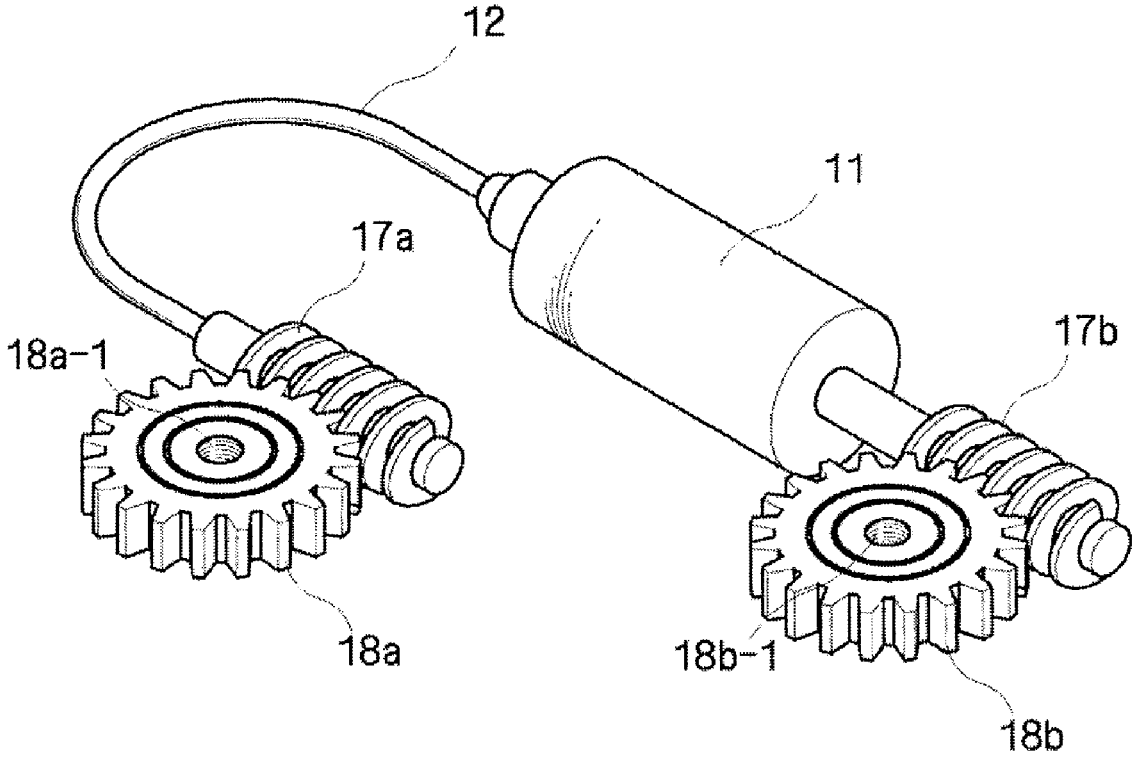
FIGS. 10A and 10B are views for explaining the way in which the driving part of the adjustable pedal system of FIG. 1 operates.
Figure 10B:
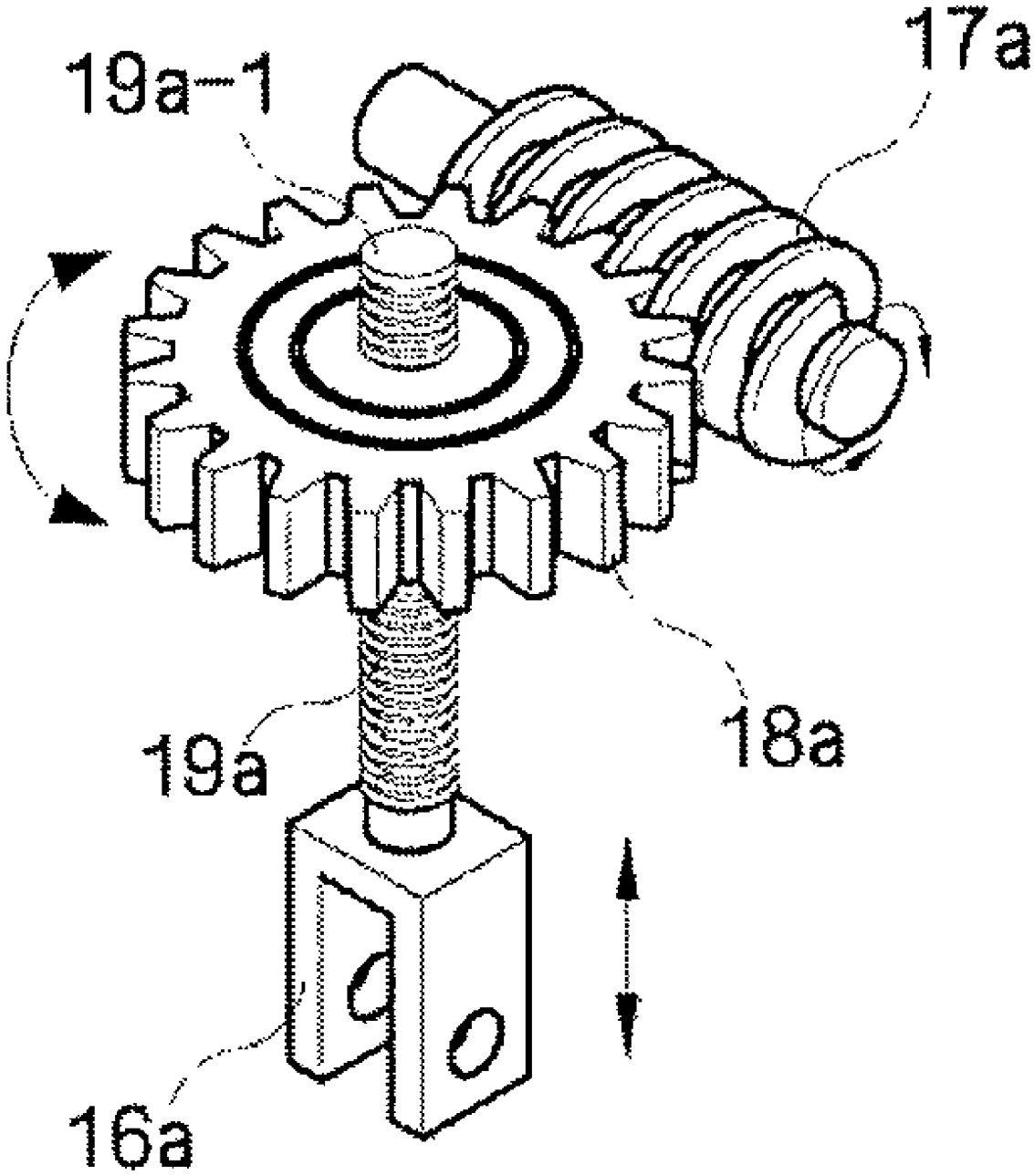

FIGS. 10A and 10B are views for explaining the way in which the driving part 10 of the adjustable pedal system 100 of FIG. 1 operates.

Referring to FIG. 10A, the rotation motor 11 may be indirectly connected to a first worm gear 17*a* by the hard wire 12 and directly connected to a second worm gear 17*b*. The hard wire 12 is a component that remotely delivers rotary power of the rotation motor 11. If structurally allowed, the first worm gear 17*a* may also be directly connected to the rotation motor 11.

The rotary motion of the rotation motor 11 is delivered to the first and second worm gears 17*a* and 17*b* which engage with first and second pinion gears 18*a* and 18*b*, respectively. Here, a gear ratio of a worm gear and a pinion gear may determine a rotation ratio of the worm gear and the pinion gear. Taps 18*a*-1 and 18*b*-1 may be formed in the centers of the first and second pinion gears 18*a* and 18*b* and coupled to the screws, respectively.

Referring to FIG. 10B, when the worm gear 17*a* rotates, the first pinion gear 18*a* may also rotate according to a predetermined gear ratio. Then, the jackscrew 19*a* which engages with the tap 18*a*-1 in the center of the first pinion gear 18*a* may move upward or downward in accordance with the rotation of the first pinion gear 18*a*. This is because the driving arm 16*a* integrated with the jackscrew 19*a* cannot rotate due to the first pin 34. Since the jackscrew 19*a* can move only upward or downward with respect to the first pinion gear 18*a*, a length of a portion 19*a*-1 of the jackscrew 19*a*, which protrudes upward from the first pinion gear 18*a*, may vary. Thus, the screw housing 2*a* may be designed to accommodate the portion 19*a*-1 even when the portion 19*a*-1 has its maximum length.

In the example of FIG. 10B, a rotation ratio of a worm gear to a pinion gear may be n:1, and a pitch of a screw may be "p." In this case, when the rotation motor 11 rotates once, a distance traveled by the driving arm 16*a* may be "p/n." Based on this relationship, the driving arm 16*a* can be precisely controlled.

As described above, in the adjustable pedal system 100 according to the present embodiment, the driving arms 16*a* and 16*b* can be moved using the single rotation motor 11. Thus, the inconvenience of having to control a plurality of control pedals individually can be reduced, and the control pedals can be controlled in connection with each other. That is, if a driver selects a desired position of the brake pedal 22, the accelerator pedal 41 can also be adjusted accordingly. This is because the structure of the adjustable pedal system 100 shown in FIG. 3 allows the driving arms 16*a* and 16*b* to be driven using the single rotation motor 11.

This structure allows a distance and an angle, by which the brake pedal 22 is moved and rotated, to be adjusted differently from a distance and an angle, by which the accelerator pedal 41 is moved and rotated, by using the driving arms 16*a* and 16*b*. For example, if the position of a brake considerably varies from driver to driver while that of an accelerator varies relatively less considerably, a rotation ratio of the first worm gear 17*a* and the first pinion gear 18*a* may be set different from a rotation ratio of the second worm gear 17*b* and the second pinion gear 18*b* in FIG. 3. In this way, the brake pedal 22 and the accelerator pedal 41 can be adjusted differently.

The adjustable pedal system 100 according to the present embodiment may further include an electronic circuit (not shown) which is programmed in advance and remembers a setting for a control pedal according to a driver's choice. The electronic circuit may be provided by a location transducer such as a voltage divider or an encoder. This memory option may be a computer module which is integrated into the rotation motor 11 or separated from the rotation motor 11. The electronic circuit may sense the position of a control pedal or a pedal arm and transmit the sensed position to the computer module in the form of a signal.

The brake pedal 22 and the accelerator pedal 41 have been described above as examples of the control pedals. However, it is apparent to those skilled in the art that the above structure can also apply to the transmission clutch pedal. Representative vehicles to which the adjustable pedal system 100 according to the present embodiment can be applied may be automobiles. However, the application of the present invention is not limited to automobiles. That is, the adjustable pedal system 100 can be used in various forms of vehicles such as trucks and airplanes.

An adjustable pedal system according to the present invention provides at least one of the following advantages.

First, the position of a pedal can be controlled in the same way that the position of a pedal in a floor-mounting-type pedal system is controlled, without installing a rail at a lower end of the pedal. Consequently, the space inside a vehicle can be efficiently used, and the appearance of the interior of the vehicle can be improved.

Second, since no slot is formed to penetrate a support bracket, an enclosed space is formed within the support bracket. Thus, problems caused by the introduction of foreign matter into the support bracket can be solved.

Third, the adjustable pedal system according to the present invention has a simpler structure and can be made smaller than the conventional adjustable pedal system. Hence, the cost of the adjustable pedal system according to the present invention can be reduced.

However, the effects of the present invention are not restricted to the one set forth herein. The above and other effects of the present invention will become more apparent to one of daily skill in the art to which the present invention pertains by referencing the claims.

While the present invention has been particularly shown and described with reference to exemplary embodiments thereof, it will be understood by those of ordinary skill in the art that various changes in form and detail may be made therein without departing from the spirit and scope of the present invention as defined by the following claims. The exemplary embodiments should be considered in a descriptive sense only and not for purposes of limitation. Therefore, the scope of the invention is defined not by the detailed description of the invention but by the appended claims, and all differences within the scope will be construed as being included in the present invention.

What is claimed is:

1. An adjustable pedal system comprising:

a support bracket having a predetermined hole and a guide groove which are substantially perpendicular;

a driving part coupled to a driving arm which is configured to substantially vertically move along the guide groove, the driving part configured to provide a driving force to the driving arm;

a control arm comprising a hinge hole which is coupled to the driving arm by a first pin and a sliding slot which is coupled to the predetermined hole by a second pin and formed oblique to the guide groove; and a pedal arm having a pedal at one end thereof and being connected to the control arm at an other end thereof, wherein the control arm slides obliquely along the sliding slot according to the working of the driving arm when moving vertically along the guide groove and causes a position of each of the control arm and the pedal arm to be changed, and wherein the pedal arm is connected to an upper end of the pedal, and the control arm is connected to a lower end of the pedal and mechanically couples the lower end of the pedal to the first pin and the sliding slot.

2. The pedal system of claim 1, further comprising a speed controller which is installed at the first end of the pedal arm, measures a quantity of motion of the pedal arm, and adjusts a speed of a vehicle.

3. The pedal system of claim 1, wherein the pedal is connected to the control arm by inserting a film hinge formed at the lower end of the pedal into a groove formed in the control arm.

4. The pedal system of claim 1, wherein when the control arm slides with respect to the second pin, the second pin rotates at a predetermined angle.

5. The pedal system of claim 1, wherein the second pin comprises a square axis portion which is inserted into the sliding slot.

6. The pedal system of claim 1, wherein the support bracket further comprises a vertical slot which is formed in a side or both sides of the support bracket, is penetrated by the first pin, and assists the guide groove in guiding the vertical motion of the driving arm.

7. The pedal system of claim 1, wherein the driving part further comprises:

a motor;

a worm gear which rotates according to the motor;

a pinion gear which engages with the worm gear; and a jackscrew which engages with a tap in a center of the pinion gear and is connected to the driving arm.

8. The pedal system of claim 1, wherein the pedal is an accelerator pedal.

* * * * *